US008100289B1

(12) United States Patent
Tobias

(10) Patent No.: US 8,100,289 B1
(45) Date of Patent: Jan. 24, 2012

(54) CONTAINER WITH INTEGRAL LID RETAINED ONTO THE TOP OF THE SIDEWALL OF THE CONTAINER BY A LIVING HINGE, THE CONTAINER USED TO RETAIN HOT LIQUIDS

(75) Inventor: Glenn Tobias, Los Angeles, CA (US)

(73) Assignee: Earthkare Packaging Innovations Company, Los Angeles, CA (US)

( * ) Notice: Subject to any disclaimer, the term of this patent is extended or adjusted under 35 U.S.C. 154(b) by 121 days.

(21) Appl. No.: 12/661,782

(22) Filed: Mar. 24, 2010

(51) Int. Cl.
*B65D 43/14* (2006.01)
*B65D 51/04* (2006.01)

(52) U.S. Cl. ..... 220/839; 220/837

(58) Field of Classification Search ..... 220/4.23, 220/713, 836–839; 229/128
See application file for complete search history.

(56) References Cited

U.S. PATENT DOCUMENTS

| | | | | |
|---|---|---|---|---|
| 2,690,861 | A | 10/1954 | Tupper | |
| D189,586 | S | 2/1961 | Nalle, Jr. | |
| D192,296 | S | 2/1962 | Numan | |
| 3,194,468 | A | 7/1965 | Baron | |
| D204,783 | S | 5/1966 | Johnson | |
| D212,352 | S | 10/1968 | Davis | |
| 3,437,253 | A | 4/1969 | Davis et al. | |
| 3,443,715 | A | 5/1969 | Edwards | |
| 3,606,262 | A | 9/1971 | Hoff | |
| 3,860,135 | A | 1/1975 | Yung et al. | |
| D248,358 | S | 7/1978 | Thomas | |
| 5,310,081 | A | 5/1994 | McCabe | |
| 5,312,011 | A | 5/1994 | Fischer | |
| 5,667,094 | A | 9/1997 | Rapchak et al. | |
| 5,765,716 | A | 6/1998 | Cai et al. | |
| 6,164,488 | A | 12/2000 | Solland et al. | |
| 6,176,420 | B1 * | 1/2001 | Sarson et al. | 229/128 |
| D437,733 | S | 2/2001 | Kaposi | |
| 6,571,981 | B2 | 6/2003 | Rohlfs | |
| 6,601,728 | B1 | 8/2003 | Newkirk et al. | |
| 6,758,390 | B2 * | 7/2004 | Sarson et al. | 229/128 |
| 6,955,289 | B2 | 10/2005 | Green | |
| 2004/0211823 | A1 * | 10/2004 | Sarson et al. | 229/128 |
| 2006/0043100 | A1 | 3/2006 | Johnson et al. | |
| 2009/0223969 | A1 | 9/2009 | Bouie | |

* cited by examiner

*Primary Examiner* — Harry Grosso
(74) *Attorney, Agent, or Firm* — Thomas I. Rozsa

(57) ABSTRACT

A container used to retain hot liquids in manner which enables the liquid within the container to be consumed by a person holding the container in the person's hand and drinking the liquid when the lid is in either the open or closed condition. The container has the unique features of having a self-sealing lid which is retained on the container through a living hinge.

6 Claims, 12 Drawing Sheets

CONTAINER WITH INTEGRAL LID RETAINED ONTO THE TOP OF THE SIDEWALL OF THE CONTAINER BY A LIVING HINGE, THE CONTAINER USED TO RETAIN HOT LIQUIDS

BACKGROUND OF THE INVENTION

1. Field of the Invention

The present invention relates to the field of containers used to retain hot liquid and which enables the liquid to be consumed while a person holds the container in the person's hand with the lid of the container being in either the open or closed condition.

2. Description of the Prior Art

In general, containers used to retain a liquid, whether hot or cold, are known in the prior art. The following list of patents are patents known to the present inventor which are containers of various designs used to retain liquids for consumption by person holding the container and consuming the liquid contents retained within the container:

The following 21 patents and published patent applications are relevant to the field of the present invention:

1. U.S. Pat. No. 2,690,861 issued to Earl S. Tupper on Oct. 5, 1954 for "Dispensing Closure":
2. U.S. Design Pat. No. Des. 189,586 issued to George S. Nalle, Jr. on Jan. 10, 1961 for "Tumbler".
3. U.S. Design Pat. No. Des. 192,296 issued to Walfred M. Nyman on Feb. 27, 1962 for "Cup or Similar Article".
4. U.S. Pat. No. 3,194,468 issued to Ronald Baron on Jul. 13, 1965 for "Plastic Drinking Cups".
5. U.S. Design Pat. No. Des. 204,783 issued to Ronald E. Johnson and assigned to Columbus Plastics Products, Inc. on May 17, 1966 for "Drinking Cup".
6. U.S. Design Pat. No. Des. 212,352 issued to Paul Davis on Oct. 8, 1968 for "Cup".
7. U.S. Pat. No. 3,437,253 issued to Paul Davis et al. on Apr. 8, 1969 for "Disposable Plastic Cup With Stiff Gripping Section".
8. U.S. Pat. No. 3,443,715 issued to Bryant Edwards on May 13, 1969 for "Double Wall Container".
9. U.S. Pat. No. 3,606,262 issued to Teunis Van't Hoff on Sep. 20, 1971 for "Cup, Mug or Other Drinking Vessel, More Especially Made of Plastic".
10. U.S. Pat. No. 3,860,135 issued to Michael A. Yung et al. on Jan. 14, 1975 for "Container And Container-Cap Combination".
11. U.S. Design Pat. No. Des. 248,358 issued to Tommy Thomas on Jul. 4, 1978 for "Cup".
12. U.S. Pat. No. 5,310,081 issued to Brad M. McCabe on May 10, 1994 for "Integral Beverage Container".
13. U.S. Pat. No. 5,312,011 issued to Dan E. Fischer on May 17, 1994 for "Stackable Container System".
14. U.S. Pat. No. 5,667,094 issued to Thomas P. Rapchak et al. on Sep. 16, 1997 for "Container and Closure Assembly".
15. U.S. Pat. No. 5,765,716 issued to Liming Cai et al. on Jun. 16, 1998 for "Cup Protector".
16. U.S. Design Pat. No. D437,733 issued to Sascha Kaposi on Feb. 20, 2001 for "Ribbed Side Drinking Vessel".
17. U.S. Pat. No. 6,571,981 issued to Joey L. Rohlfs on Jun. 3, 2003 for "Disposable Sipper Cups".
18. U.S. Pat. No. 6,601,728 issued to Raymond Newkirk et al. on Aug. 5, 2003 for "Thermal Cup Holder".
19. U.S. Pat. No. 6,955,289 B2 issued to John Green on Oct. 18, 2005 for "Container Having an Integral Lid".

20. United States Published Patent Application No. 2006/0043100 to Joseph E. Johnson et al. for "Vial With Hinged Cap And Method of Making Same".
21. United States Published Patent Application No. 2009/0223969 to Tony V. Bouie on Sep. 10, 2009 for "Lid Assembly and Method For Use Thereof".

There is a significant need for an improved container which provides advantages which are lacking in the prior art containers.

SUMMARY OF THE INVENTION

The present invention is a container used to retain hot liquids in manner which enables the liquid within the container to be consumed by a person holding the container in the person's hand and drinking the liquid when the lid is in either the open or closed condition. The present invention container has the unique features of having a self-sealing lid which is retained on the container through a living hinge. The lid further accomplishes a positive and effective seal when the lid is closed so that leakage from the container is eliminated or at least minimized during normal use thereof. The design of the lid enables the liquid within the container to be consumed with the lid in either the closed or open condition.

It is therefore an object of the present invention to provide a container for retaining hot liquids which can be consumed from the container while a person is grasping the sidewall of the container with the person's hand.

It is a further object of the present invention to provide a container having a lid retained onto the container by an integral living hinge which enables the lid to be placed in an open condition so that liquid may be poured into the container and which enables the container to thereafter be sealed with a positive and effective seal.

It is an additional object of the present invention to provide a container having integral tab means to enable the container to be opened after it has been positively sealed so that more liquid can be poured into the container or liquid can be removed from the container.

It is also an object of the present invention to provide a container with a lid retained by a living hinge so that the lid is integral with the container and will not be inadvertently lost or soiled which is a problem with prior art containers which have a separately affixed lid.

It is a further object of the present invention to provide a container which enables liquid to be consumed from the container when the lid is in either the closed or open condition.

It is also an object of the present invention to provide a container made out of biodegradable material so that the material can be reused and is eco-friendly.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
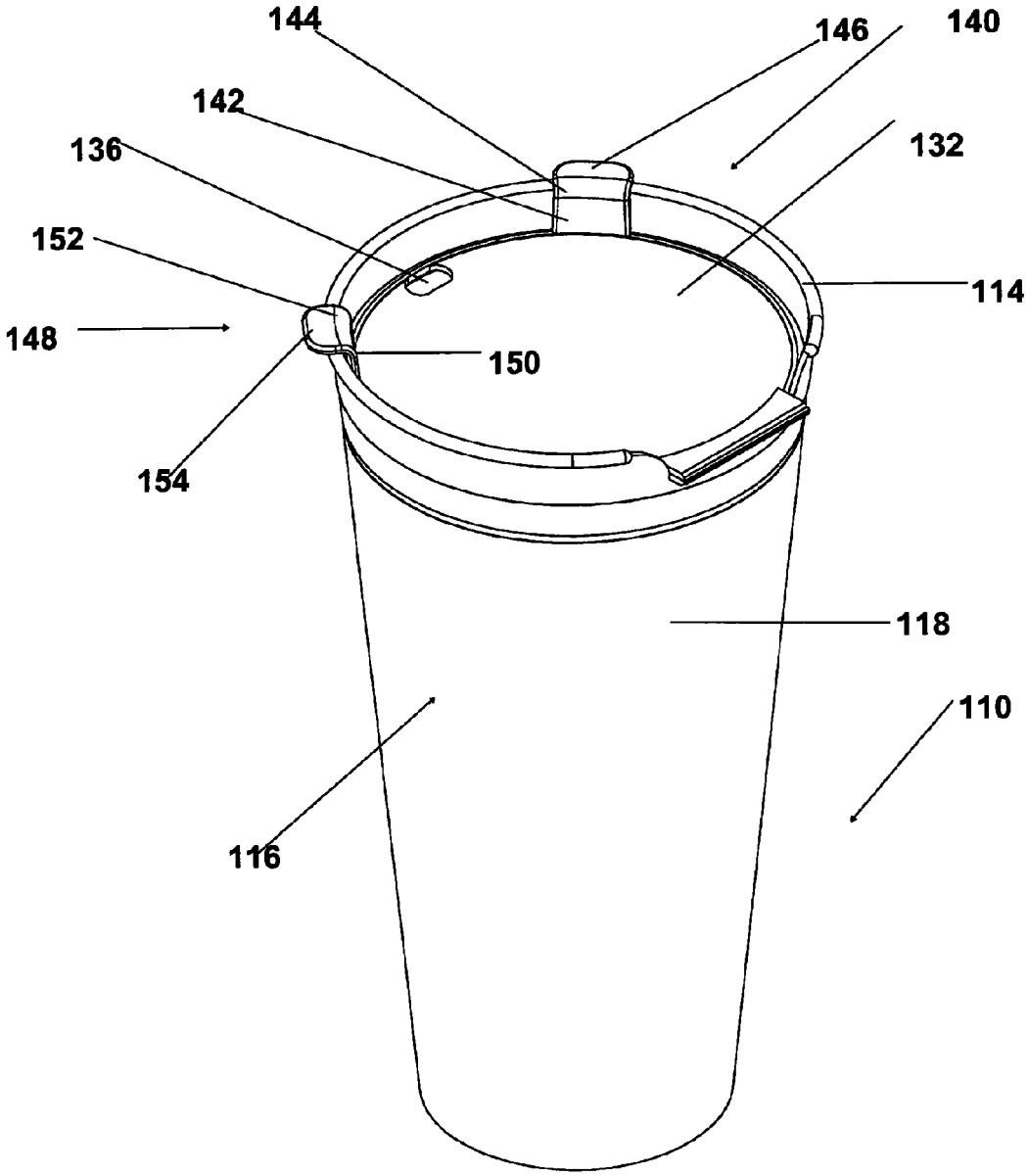
FIG. 1 is a perspective view of the present invention container with an integral lid retained on the container by a living hinge, the container shown with the lid in the closed condition.
Figure 2:
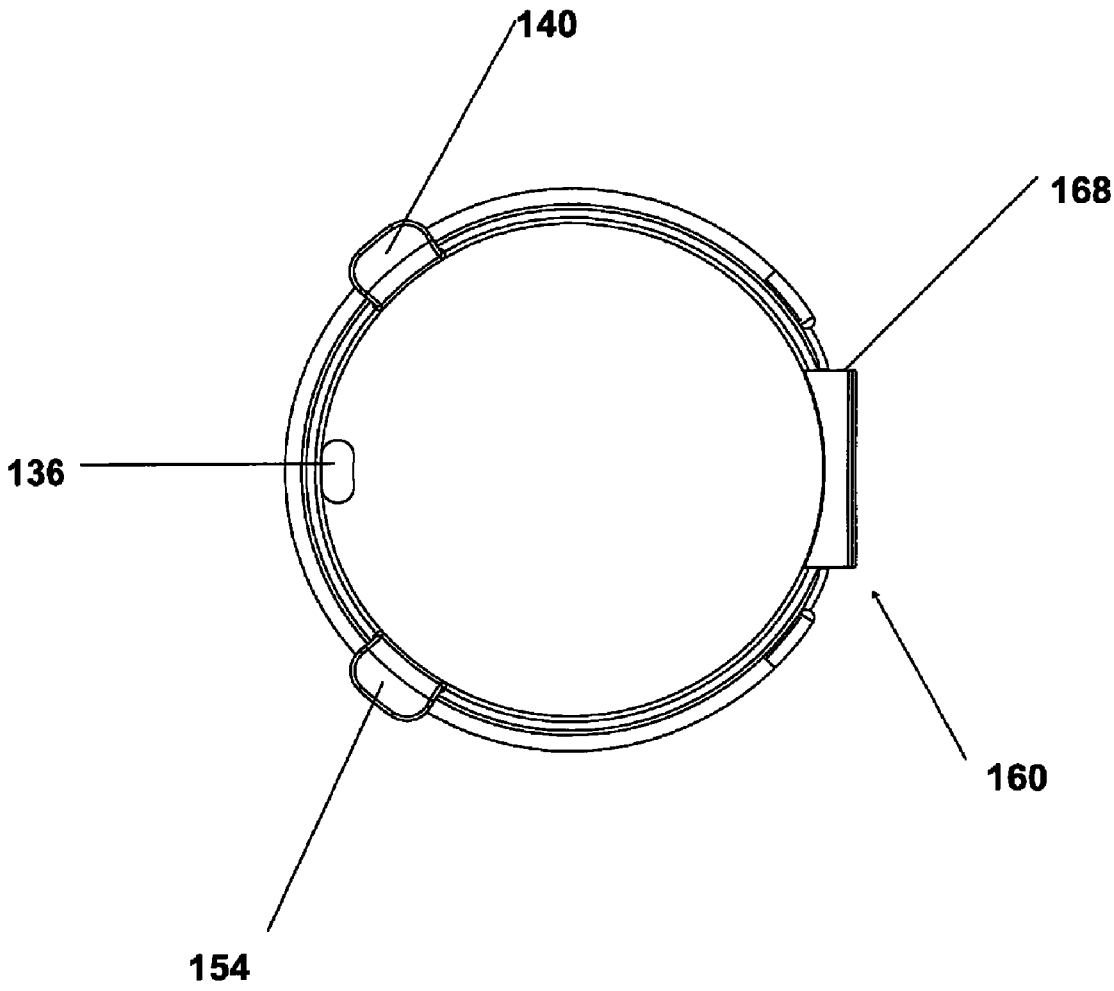
FIG. 2 is a top plan view of the container with the lid in the closed condition.
Figure 3:
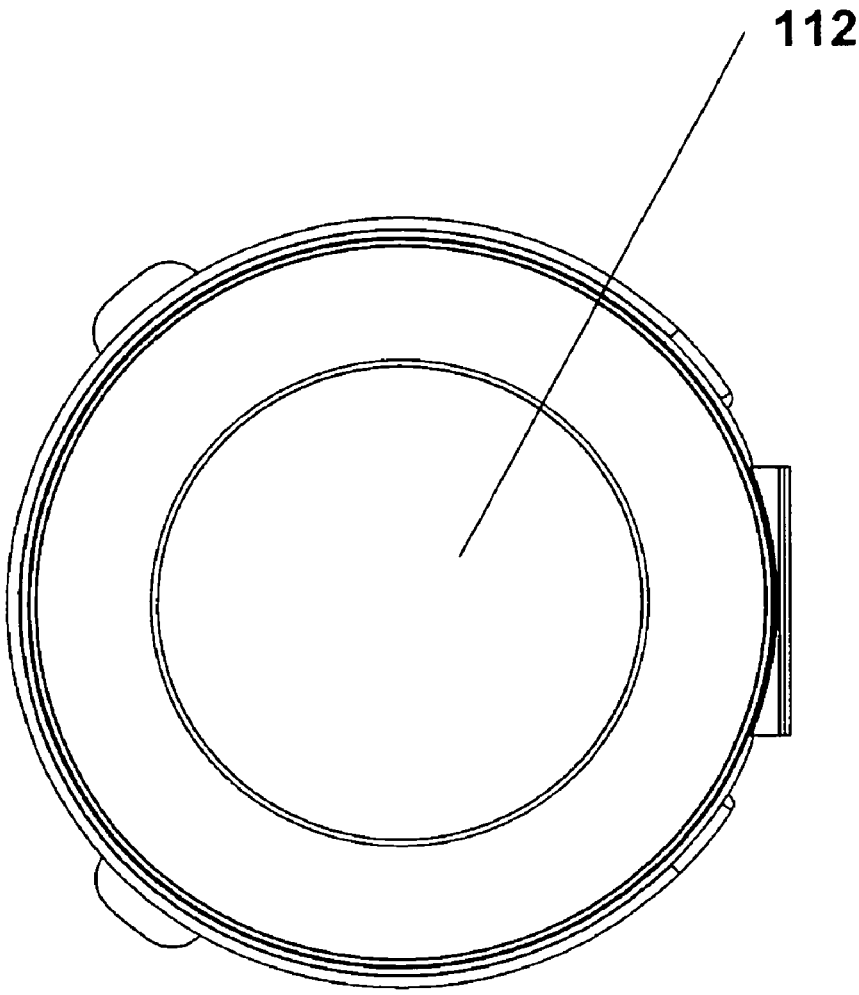
FIG. 3 is a bottom plan view of the container with the lid in the closed condition.
Figure 4:
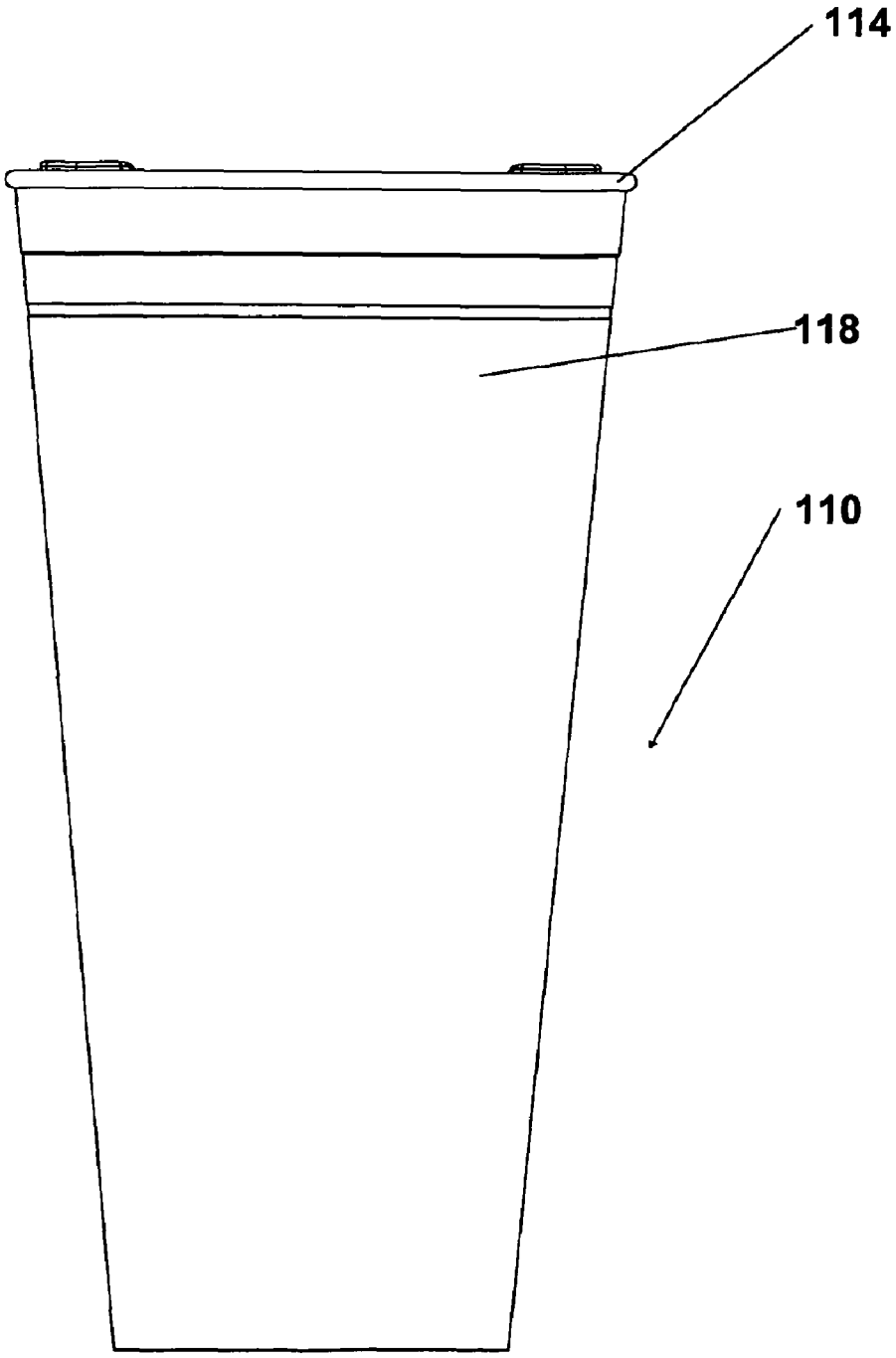
FIG. 4 is a front elevational view of the container with the lid in the closed condition.
Figure 5:
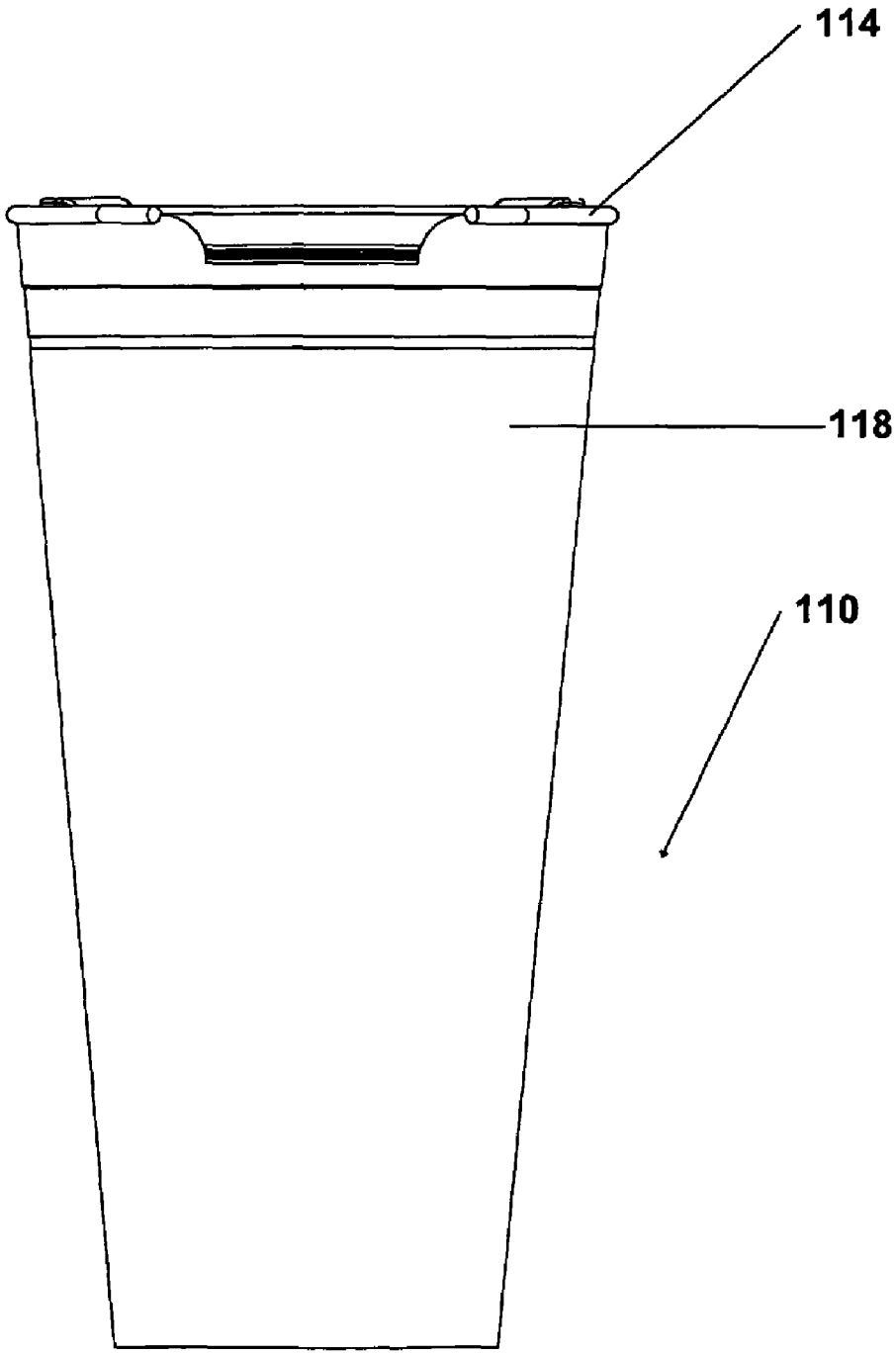
FIG. 5 is a rear elevational view of the container with the lid in the closed condition.
Figure 6:
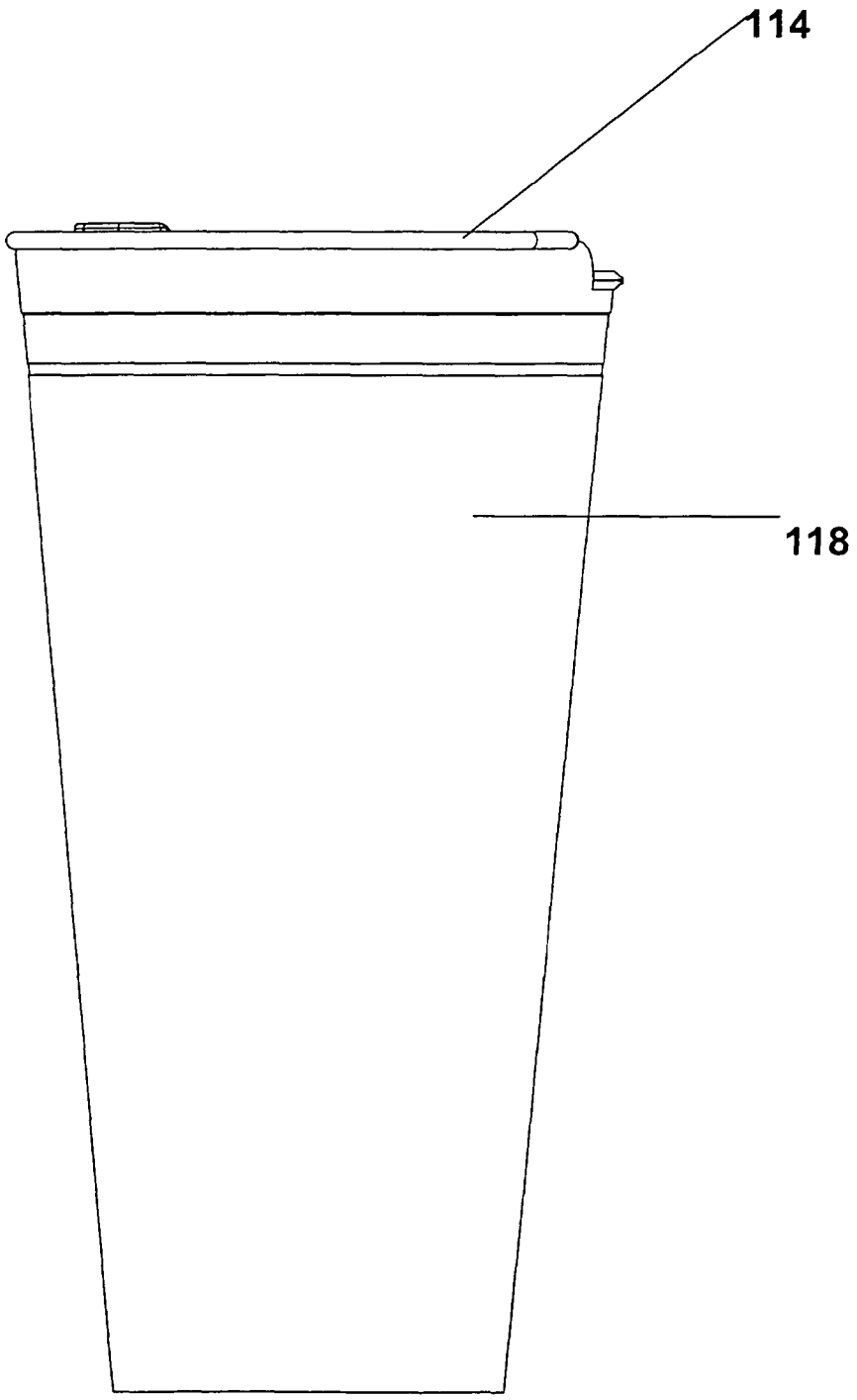
FIG. 6 is a side elevational view of the container with the lid in the closed condition, the view taken when viewed from the left side, the right side elevatonal view being a mirror image thereof.
Figure 7:
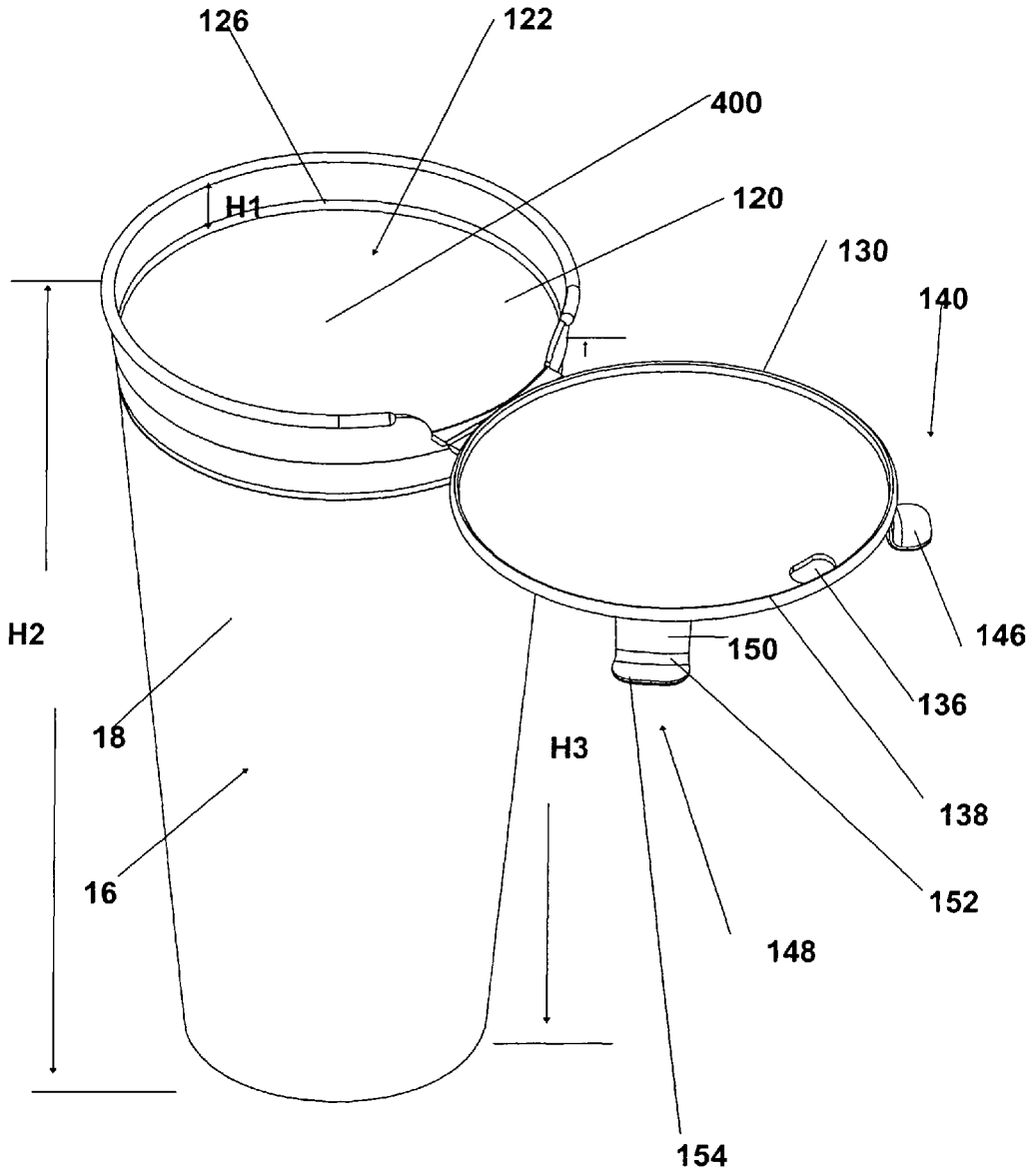
FIG. 7 is a perspective view of the present invention container with an integral lid retained on the container by a living hinge, the container shown with the lid in the open condition.
Figure 8:
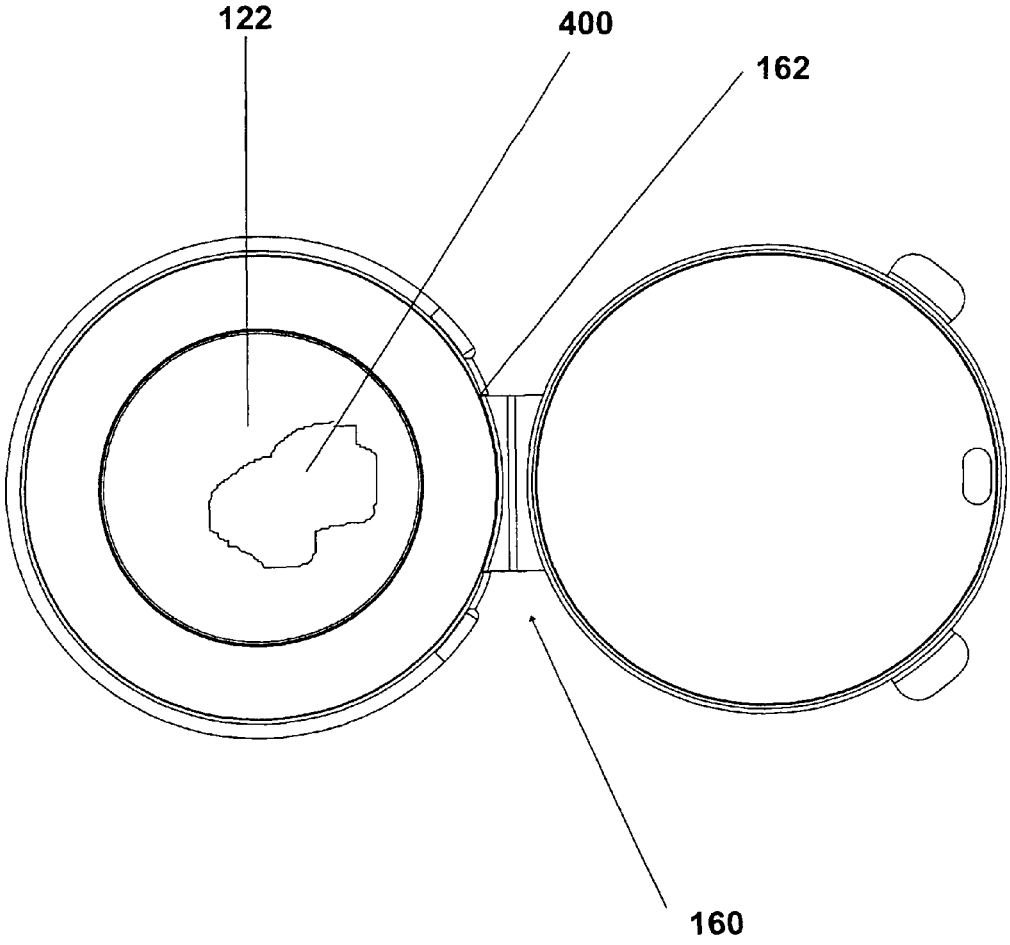
FIG. 8 is a top plan view of the container with the lid in the open condition.
Figure 9:
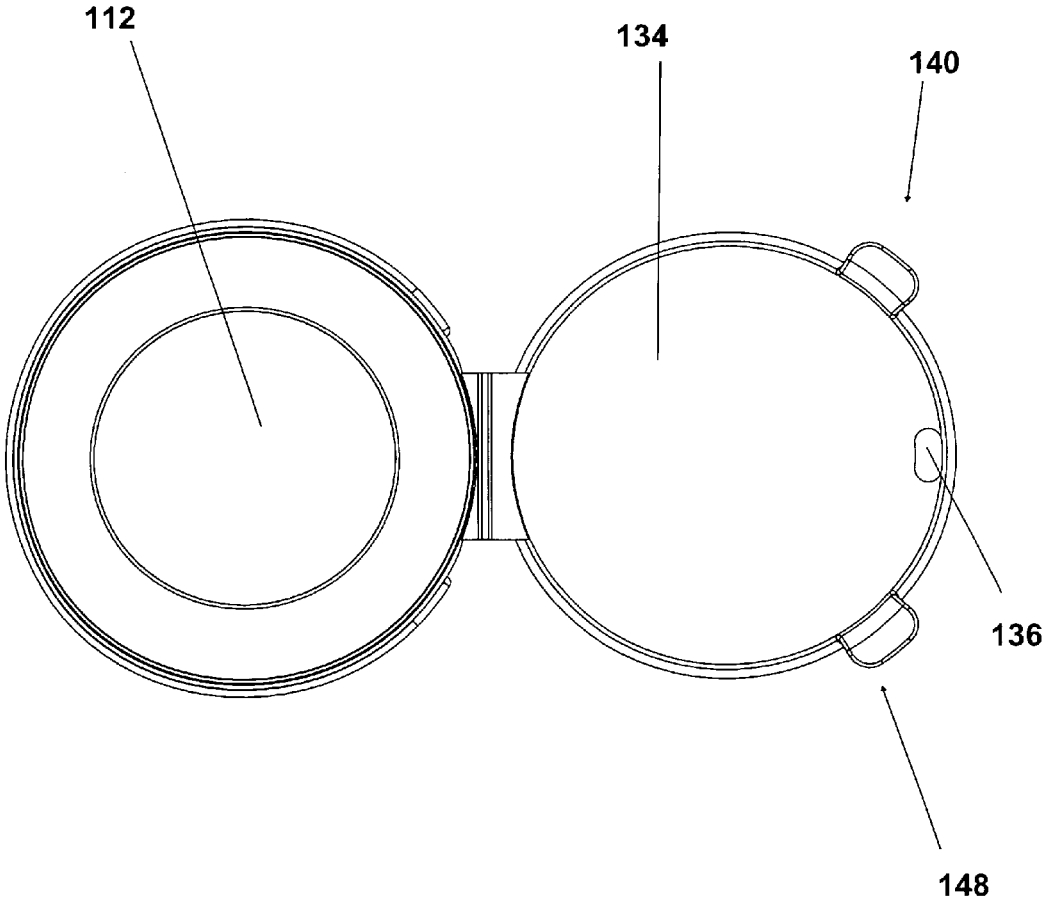
FIG. 9 is a bottom plan view of the container with the lid in the open condition.
Figure 10:
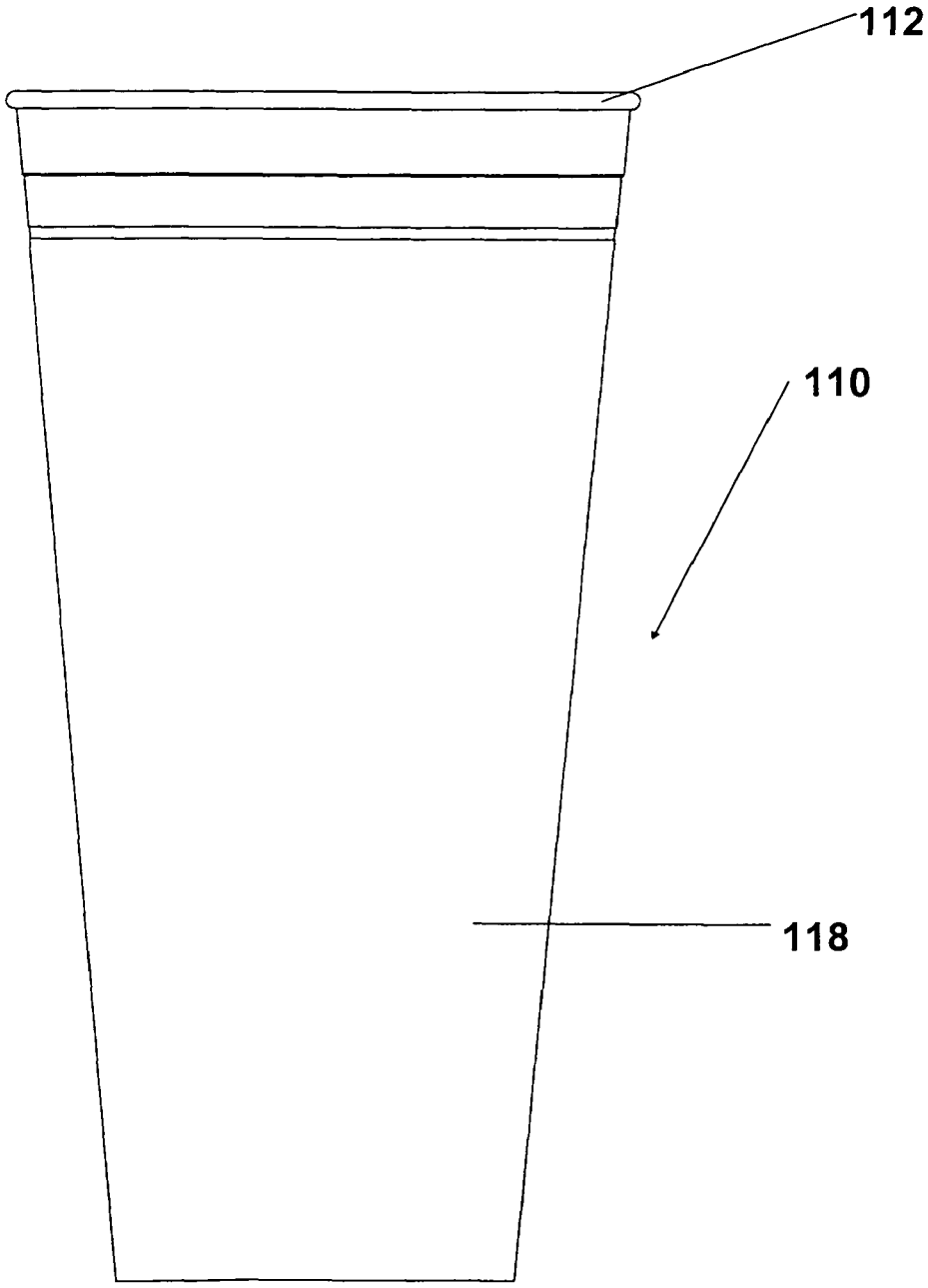
FIG. 10 is a front elevational view of the container with the lid in the open condition.
Figure 11:
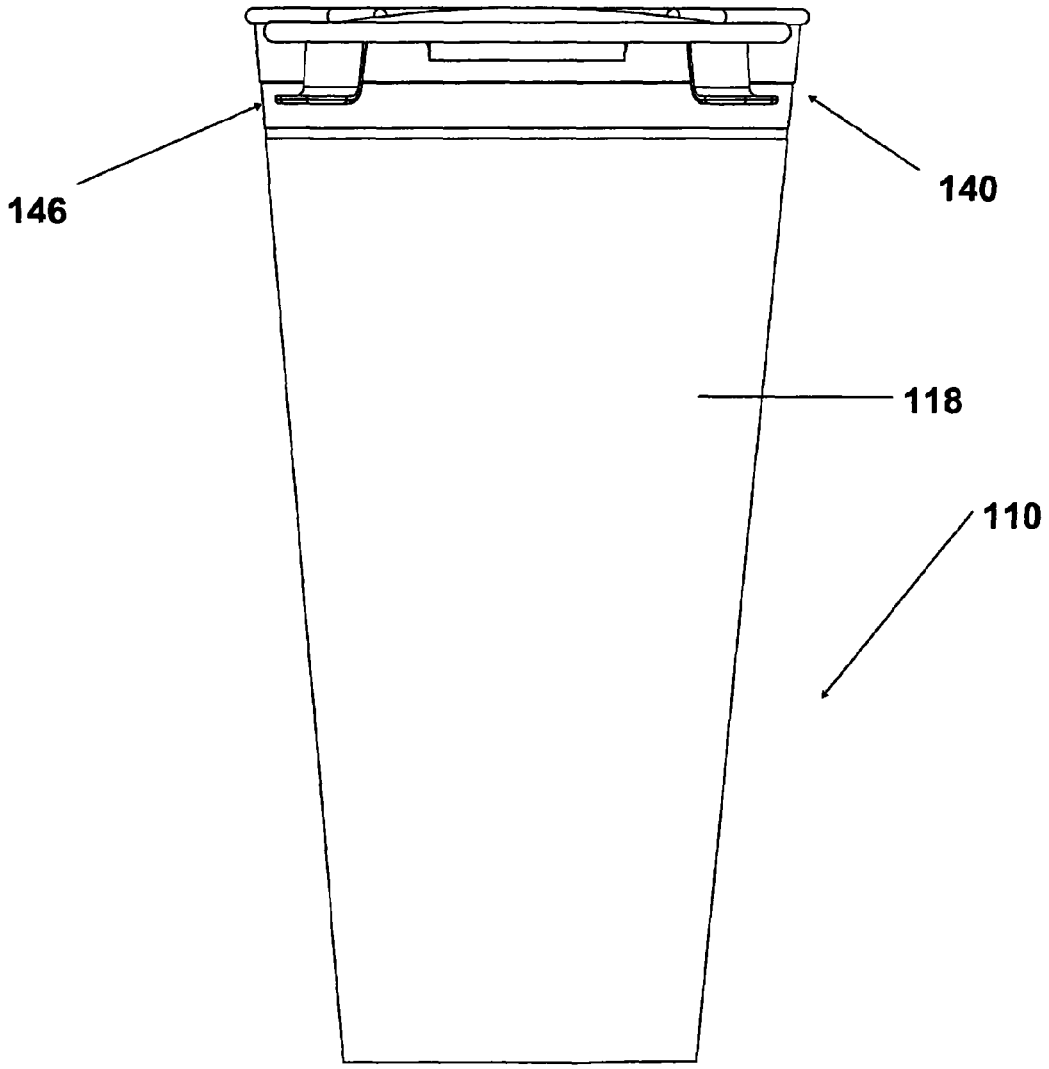
FIG. 11 is a rear elevational view of the container with the lid in the open condition.
Figure 12:
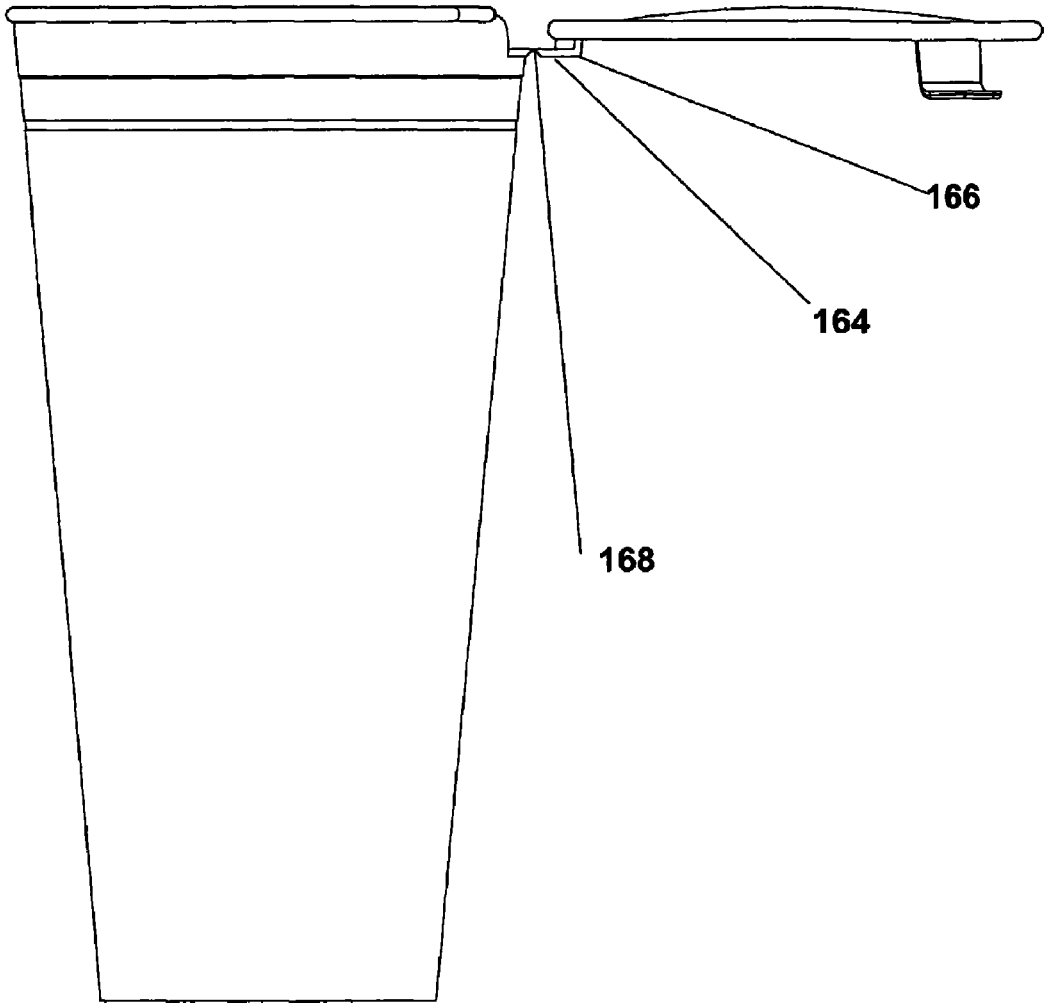
FIG. 12 is a side elevational view of the container with the lid in the open condition, the view taken when viewed from the left side, the right side elevational view being a mirror image thereof.

Referring to FIGS. 1 through 12, the present invention cup or container 110 includes a bottom 112 and a rim 114 and a continuous wall 116 interconnecting the bottom 112 and the rim 114. The continuous wall has an exterior surface 118 and an interior surface 120. The container has an interior chamber 122 surrounded by the wall 116 and bottom 112. Disposed below the rim 114 at a distance "H1" is an interior groove 126 which extends for a continuous given circumferential distance along the interior circumference of interior wall 120. The rim 1114 is aligned with and extends for approximately the same circumferential distance as the groove 126. The continuous wall 116 extends for approximately the same circumferential distance as the rim 114 and at a given height "H2" and then slopes downwardly to a lower wall 116A having a height "H3" which is below rim 114 and above interior groove 126.

The lid 130 of the present invention is generally circular in shape and has a top surface 132 and a bottom surface 134 with a sip opening 136 extending through the lid 130 from the bottom surface 134 to the top surface 132, the sip opening 136 preferably located adjacent the exterior circumference 138 of the lid 130. A flexible living hinge 160 is integrally formed with the container wall 116 and lid 130 with an interior end 162 formed with and resting against lower wall 116A and an exterior end 164 terminating in a vertical member 166 formed into lid 130. The living hinge 160 has an recess or cut 168 about which the living hinge 160 can rotate.

The lid 130 has at least one and preferably a pair of spaced apart tabs 140 and 148 integrally formed with the lid and adjacent the exterior circumference 138 of the lid 130. First tab 140 includes a vertical section 142, first bent section 144 and a transverse section 146. Second tab 148 includes a vertical section 150, a first bent section 152 and a transverse section 154. In the preferred embodiment, the first and second tabs 140 and 148 are located on the rim 130 at approximately equal distances from the location where the lid 130 is attached to the living hinge 140 and at locations on the lid 130 at opposite spaced apart locations from the sip opening 136.

When in the closed condition, the lid 130 and living hinge 160 are rotated about cut 168 in living hinge 160 so that circumference 138 of lid 310 is retained within groove 126. The fit enables the lid 130 to form a seal at the location of the groove 126 so that liquid 400 contained in the interior chamber 122 will not spill out. The tabs 140 and 148 are positioned so that respective transverse sections 146 and 154 rest over and against rim 114. As a result, because of the tight fit of the lid 130 within groove 126, it would be difficult to pull the lid 30 free without the transverse sections 146 and 154 which extend above and rest on the rim 114 so that one or both tabs 140 and/or 148 can be pulled on to overcome the force of the lid 130 within the groove 126 to open the container 110 and permit more liquid 400 to be poured into chamber 122 or to permit the liquid to be consumed by a person placing the person's lips on the rim 114. With the lid 130 in the closed condition, the liquid can be consumed by sipping the liquid 400 through sip opening 138 in lid 130. When in the closed condition, the space surrounded in the interior wall 118 and lid 130 can retain any liquid 400 that spilled out of sip opening 138 or may bleed out of the chamber 122 at the location of the intersection of the lid 130 and groove 126.

Therefore, through this design, any liquid but primary liquid 400 that is hot can be retained in the chamber 122 and sipped through opening 138 while the tight sealing fit of the lid 130 within interior groove 126 will assure that no liquid 400 will inadvertently spill out.

The entire container 110 including the wall 116 and bottom 112, lid 130, living hinge 160 and tabs 140 and 148 are preferably made out of biodegradable material which can be melted down and reformatted into a new container. The container 110 and its components can also be made out of polyurethane foam, or food grade polyethylene terephthalate (PET) so that it is a disposable container.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A container used to retain a liquid, comprising:

a. a bottom, a rim, a continuous sidewall interconnecting the bottom and the rim, the continuous sidewall having an exterior surface and an interior surface, the container having an interior chamber surrounded by the continuous sidewall and the bottom, an interior groove in the interior surface of the continuous sidewall and disposed below the rim at a given distance, the interior groove extending for a continuous given circumferential distance along the interior circumference of interior surface of the continuous sidewall, the rim aligned with and extending for approximately the same circumferential distance as the interior groove, the continuous sidewall extending for approximately the same circumferential distance as the rim at a given height and then sloping downwardly to a lower sidewall section having a height which is below rim and above interior groove; and b. a lid being generally circular in shape and having a top surface and a bottom surface with a sip opening extending through the lid from the bottom surface to the top surface, the sip opening located adjacent an exterior circumference of the lid, a flexible living hinge integrally formed with the container sidewall and lid with an interior end formed with and resting against the lower sidewall section and an exterior end terminating in a vertical member formed into lid, the living hinge having a recess about which the living hinge can rotate, the lid having a pair of spaced apart tabs integrally formed with the lid and adjacent the exterior circumference of the lid, a first tab including a vertical section, a first bent section and a transverse section, a second tab including a vertical section, a first bent section and a transverse section, the first and second tabs located on the rim at approximately equal distances from the location where the lid is attached to the living hinge and at locations on the lid at opposite spaced apart locations from the sip opening, And when in the closed condition, the lid and living hinge are rotated about the recess in the living hinge so that the circumference of the lid is retained within the interior groove in the sidewall to form a seal at the location of the groove, the tabs positioned so that their respective transverse sections rest over and against the rim.

2. The container in accordance with claim 1 wherein the container is made out of material selected from the group consisting of biodegradable material, polyurethane foam, and or food grade polyethylene terephthalate.

3. A container used to retain a liquid, comprising:

a. a bottom, a rim, a sidewall interconnecting the bottom and the rim, the sidewall having an exterior surface and an interior surface, the container having an interior chamber surrounded by the sidewall and the bottom, an interior groove in the interior surface of the sidewall and disposed below the rim at a given distance, the interior groove extending for a continuous given circumferential distance along the interior circumference of the interior surface of the sidewall, the sidewall extending for approximately the same circumferential distance as the rim at a given height and then sloping downwardly to a lower sidewall section; and b. a lid having a top surface and a bottom surface with a sip opening extending through the lid from the bottom surface to the top surface, the lid having an exterior circumference, a flexible living hinge integrally formed with the container sidewall and lid with an interior end formed with the lower sidewall section and an exterior end formed into the lid, the lid having at least one tab integrally formed with the lid and adjacent the exterior circumference of the lid and having a vertical section, a first bent section and a transverse section, and when the lid is closed the lid and living hinge are rotated about a recess in the living hinge so that the circumference of the lid is retained within the interior groove in the sidewall to form a seal at the location of the groove, the at least one tab positioned so that its transverse section rests over and against the rim.

4. The container in accordance with claim 3 wherein the container is made out of material selected from the group consisting of biodegradable material, polyurethane foam, and or food grade polyethylene terephthalate.

5. A container used to retain a liquid, comprising:

a. a bottom, a rim, a sidewall interconnecting the bottom and the rim, the sidewall having an exterior surface and an interior surface, the container having an interior chamber surrounded by the sidewall and the bottom, an interior groove in the interior surface of the sidewall and disposed below the rim at a given distance, the interior groove extending for a continuous given circumferential distance along the interior circumference of interior surface of the sidewall; and b. a lid having a top surface and a bottom surface with a sip opening extending through the lid from the bottom surface to the top surface, the lid having an exterior circumference, a flexible living hinge integrally formed with and interconnecting the container sidewall and lid, the lid having at least one tab integrally formed with the lid and adjacent the exterior circumference of the lid and having a transverse section, and when the lid is closed the lid is rotated so that the circumference of the lid is retained within the interior groove in the sidewall to form a seal at the location of the groove, the at least one tab positioned so that its transverse section rests over and against the rim.

6. The container in accordance with claim 5 wherein the container is made out of material selected from the group consisting of biodegradable material, polyurethane foam, and or food grade polyethylene terephthalate.

* * * * *